United States Patent [19]

Hill

[11] Patent Number: 4,641,768

[45] Date of Patent: Feb. 10, 1987

[54] TEEMING APPARATUS AND METHOD

[75] Inventor: Paul L. Hill, Chesterfield, United Kingdom

[73] Assignee: USS Engineers and Consultants, Inc., Pittsburgh, Pa.

[21] Appl. No.: 719,089

[22] Filed: Apr. 2, 1985

[30] Foreign Application Priority Data

May 11, 1984 [GB] United Kingdom ..... 8412101

[51] Int. Cl.[4] ..... B22D 41/08

[52] U.S. Cl. ..... 222/590; 222/592; 222/600; 266/236

[58] Field of Search ..... 222/590, 592, 593, 603, 222/600, 559, 561, 148; 164/415, 475, 477; 266/236, 237, 241

[56] References Cited

U.S. PATENT DOCUMENTS

| | | | |
|---|---|---|---|
| 3,581,948 | 6/1971 | Detalle | 222/561 |
| 3,809,146 | 5/1974 | Andrzajak et al. | 164/66 |
| 3,825,241 | 7/1974 | Shapland | 266/38 |
| 3,918,613 | 11/1975 | Shapland, Jr. | 222/148 |
| 4,219,188 | 8/1980 | Meier | 266/236 |

FOREIGN PATENT DOCUMENTS

| | | | |
|---|---|---|---|
| 2411542 | 8/1979 | France | 222/600 |
| 5420938 | 7/1979 | Japan . | |
| 0105862 | 8/1981 | Japan | 222/600 |
| 1492534 | 11/1977 | United Kingdom . | |

*Primary Examiner*—Joseph J. Rolla
*Assistant Examiner*—Nils E. Pedersen
*Attorney, Agent, or Firm*—John F. Carney

[57] ABSTRACT

A molten metal teeming valve of the sliding gate type is equipped with means for the injection of gas for various purposes including refractory preheating, lancing, or cooling, etc. The gas injecting apparatus is arranged within the valve organization in a manner that will prevent impingement of the injected gas streams on the refractory valve elements thereby avoiding damage to such elements.

10 Claims, 8 Drawing Figures

TEEMING APPARATUS AND METHOD

BACKGROUND OF THE INVENTION

The present invention relates to improvements in metal teeming apparatus and methods. More specifically, the invention relates to a particular arrangement for, and method of operating, a metal teeming apparatus of the sliding gate tape in whicn gas can be advantageously injected for any of a plurality of purposes.

When molten metal is teemed from a vessel, such as a ladle, the outflow of metal is often controlled by a sliding gate valve. One such valve has a plurality of orificed refractory plates, one of which is a slidably movable gate plate. It is not uncommon for the movable gate of a sliding gate valve to become blocked by matter solidifying in the gate plate orifice or downstream thereof. When this happens, the valve may need to be taken out of service, be disassembled and have new refractories fitted. The operator may, instead, endeavor to "lance" the valve clear by a blast of reactive gas. Lancing is hazardous. Moreover, in many valve systems the gas so impinges on the refractories that it can actually harm them.

SUMMARY OF THE INVENTION

An object of this invention is to provide a valve arrangement which facilitates the safe introduction of gas and which is unlikely to suffer harm by the action of admitting the gas thereto. The invention also aims to provide a valve which offers the operator the option of performing other gas-using operations, and not just lancing, for safety or other reasons.

The invention is directed to a sliding gate valve for metal teeming operations, of the kind comprising at least two refractory valve plates having respective teeming orifices, one plate being a gate plate movable relative to a stationary plate upstream thereof, for opening and closing the valve to metal flow by bringing the said orifices into and out of registry.

According to the present invention, there is provided a valve of the kind hereinbefore defined, wherein the stationary plate has a second orifice in addition to its teeming orifice with which the teeming orifice of the gate plate is registrable and the valve includes means to feed gas into the second orifice for admission to the gate orifice, when these orifices are registered, the gas being fed in a direction avoiding direct impingement of the gas on the gate refractory bordering the gate orifice.

The invention comprehends a vessel such as a ladle fitted with the valve just defined.

The invention further comprehends a method of teeming molten metal involving use of the aforesaid valve and gas injection for the purpose(s) of preheating and/or lancing and/or freezing melt inside the valve plate arrangement to arrest a leakage of metal from the valve when it is closed.

BRIEF DESCRIPTION OF THE DRAWINGS

The invention will now be described in more detail by way of example only with reference to the accompanying drawings, in which.

DESCRIPTION OF A PREFERRED EMBODIMENT OF THE INVENTION

Figure 1:
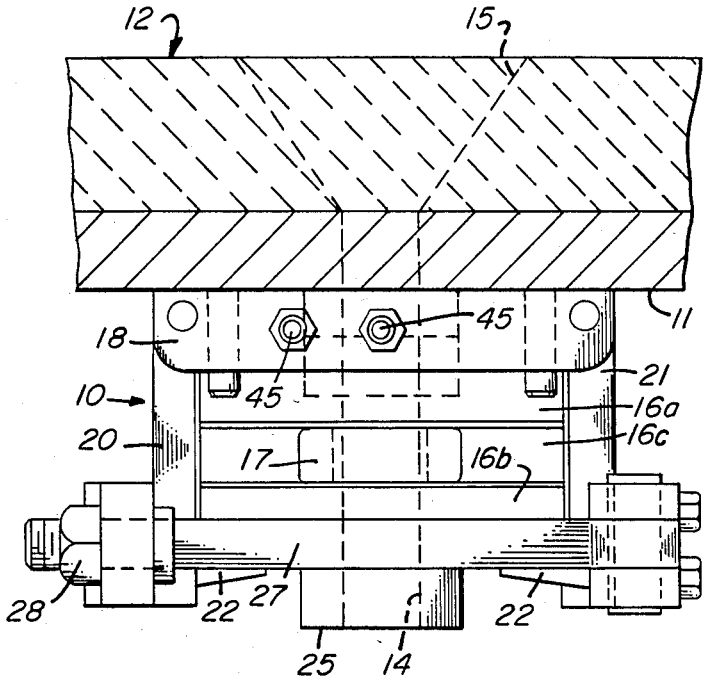
FIG. 1 is an end view of a valve for use in practicing this invention.
Figure 2:
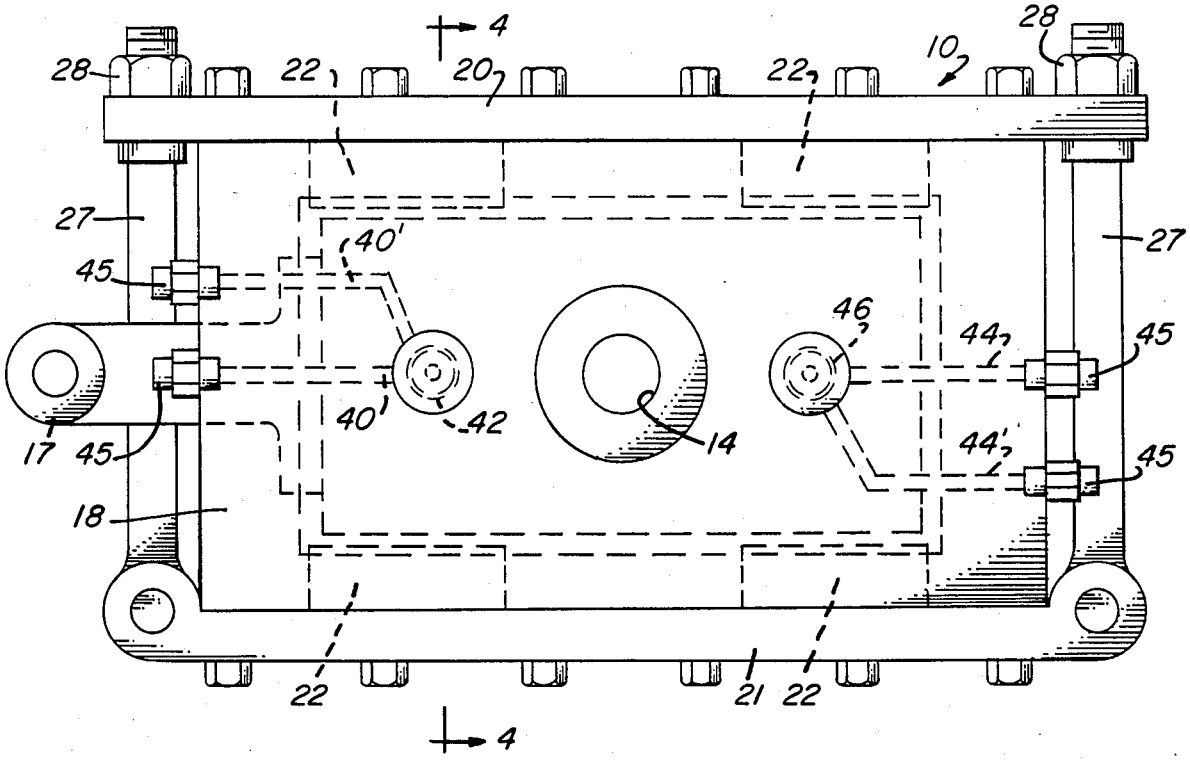
FIG. 2 is a plan view of the valve.

The general details of the valve organization 10 illustrated in the drawing figures and incorporating the present invention are particularly described in United Kingdom Patent Application No. 8412100. They are, accordingly, described herein only to the extent required for an understanding of the present invention.

The valve 10 adapted for practicing this invention is shown attached to the bottom 11 of a bottom pour vessel, such as a ladle 12. The valve has its pour passage 14 coincident with a bottom pour opening 15 of the vessel. The pour passage 14 is defined by alignable orifices in a plurality of refractory valve members or plates 16*a*, 16*b* and 16*c* of the valve 10. The said plates are mutually relatively movable for bringing the orifices into or out of registry to control flow through the valve.

The valve has a mounting plate 18 secured to vessel bottom wall 11 in any convenient way. Depending from the mounting plate 18, and hinged to opposite sides, thereof, are two side members 20, 21. The side members carry rocker arms 22 adjacent their lower edges. The rocker arms 22 serve as supporting means for the refractory valve members 16. There are, for example, four such rocker arms. Each arm is biased to exert an upward force on the valve members 16. The upward force thrusts the valve members 16 towards the mounting plate 18 and into tight face-to-face contact with one another. The contact of one plate with another is such that molten metal cannot significantly insinuate itself between the plates. Nevertheless, relative movement of the plates 16 is still possible. The rocker arms 22 are biased by spring forces stored in torsion bars 24 non-rotationally fixed at their ends to the rocker arms 22 and one or other side member 20, 21. Two torsion bars 24 may act on each rocker arm 22.

The illustrated valve has three orificed valve plate members, 16*a*, 16*b*, and 16*c*. The top plate 16*a* is stationary, as is the bottom plate 16*b*. The latter has a discharge nozzle 25 projecting downwards therefrom, the nozzle being integral with or attached in any suitable manner to the bottom plate 16*b*. The third or middle plate 16*c* of the valve 10 is the movable plate. It can be reciprocally movable or of the push-through or cassetted type. By appropriate movement of the middle plate 16*c*, its teeming orifice is brought into and out of registry with the orifices of the other plates and the bore of the nozzle 25, to open or close the valve to flow.

The valve refractories 16*a*, 16*b*, 16*c* and 25 are installed and removed after swinging the side members 20, 21 apart about their respective hinges. Having installed the refractories, the side members are swung together and fastened to one another. Pivoted bolts 27 with nuts 28 serve to fasten the side members 20, 21 together, and when so fastened the refractories are supported on the rocker arms 22. By tightening the nuts, the side members 20, 21 are drawn closer to one another. The geometry and dimensions of the valve are so arranged that the rocker arms 22 are deflected as the nuts 28 are tightened, thus loading or stressing the torsion bars 24. The energy so stored in the torsion bars 24 causes the rocker arms 22 to bias the respective refractories towards the mounting plate 18.

Figure 3:
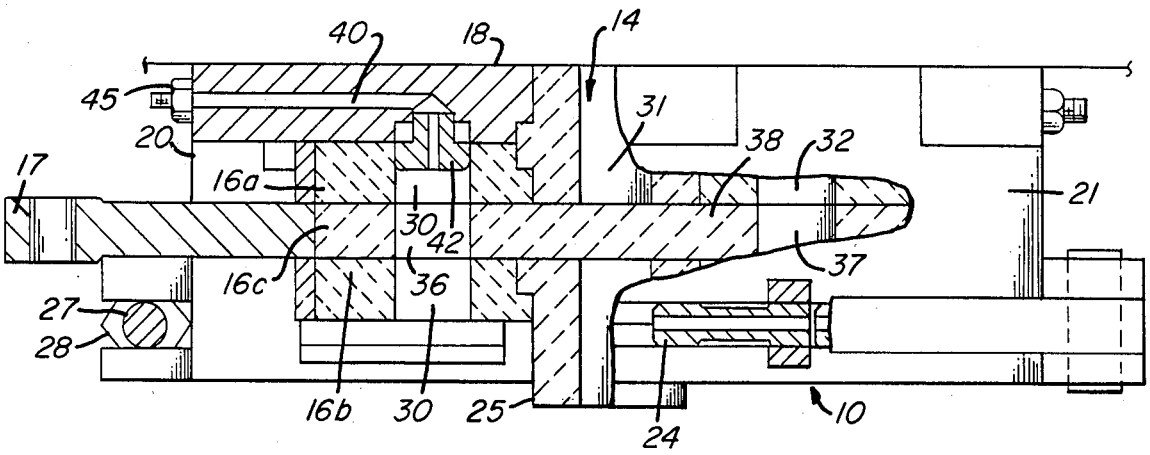
FIG. 3 is a side view, partly in section, of the valve of FIG. 1.
Figure 4:
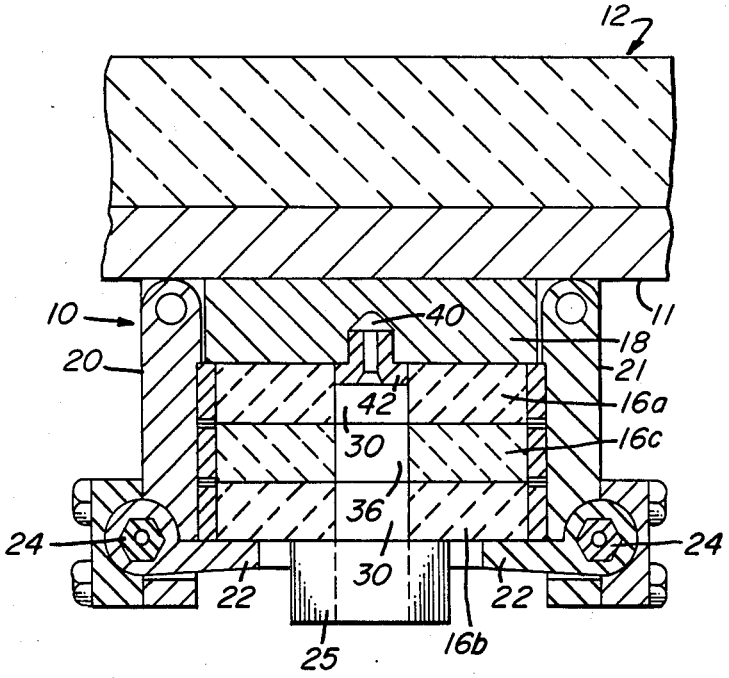
FIG. 4 is a sectional end view of the valve, taken on the line 4—4 of FIG. 2.

In the valve 10, both stationary plates, 16*a* and 16*b*, have three orifices 30, 31, 32, as shown in FIG. 3. The orifices in plate 16*a* are directly above the corresponding orifices in plate 16*b*. The orifices 30 to 32 are linearly disposed in both plates 16*a*, 16*b*. Each central orifice 31 is equidistant from the orifices 30, 32 flanking it. In each said plate 16*a*, 16*b*, the orifices 30, 31, 32 are in a line parallel to the direction of advancing movement of the slidable gate plate 16*c*. The latter is movable from left to right in FIG. 3. An orifice in the gate plate 16*c* can be brought into registry with any one of the orifices 30, 31, 32. The central orifices define part of the valve flow passage 14. The orifices 30, 31 and 32 can be the same or different sizes, but are normally the same size.

The cassetted gate plate 16*c*, which is driven by operator 17, may have but one orifice or a plurality of orifices. As shown, the plate 16*c* has two orifices 36, 37, either of which can be moved into registry with the central orifices 31 to open the valve 10 to flow. The orifices 36, 37 may be the same or different sizes, for example the same size as the orifices 31. When neither orifice 36, 37 is in registry with the aligned central orifices 31, as shown in FIG. 3, the valve is closed against flow. An imperforate portion 38 of the gate plate 16*c* is then located between the orifices 31.

According to the present invention, the valve 10 is provided with means to feed or inject a selected gas centrally into a gate plate orifice, in a direction generally parallel to the wall thereof, such that the gas does not impinge directly on said wall. The gas is admitted to said orifice in a downward direction, substantially parallel to the axis of the flow channel 14. The gas is fed into the valve via a passage in the mounting plate 18. The passage has a downwardly directed gas outlet member for conveying gas downwardly into an orifice of the stationary upper plate 16*a*. It will be appreciated that gas can only enter a gate plate orifice if the latter is registered with the aforesaid upper plate orifice. Gas entering the gate plate orifice escapes from the valve via the lower stationary plate orifice with which the upper plate orifice is also registered.

As disclosed herein, the valve 10 has two orifices 30 and 32 oppositely spaced from the melt flow orifice 31 in the stationary plate 16*a*. Gas can be fed into either or both of the orifices 30, 32. For orifice 30, the mounting plate 18 has gas passages 40 and 40' leading to a downwardly directed gas outlet member 42. Similarly, for orifice 32 there are passages 44 and 44' and outlet member 46 in the mounting plate 18. The passages 40, 40', 44, 44' are separate so that gases can be fed to the orifices 30, 32 independently. Accordingly, different gases can be introduced into the orifices. The passages 40, 40', 44, 44' lead to opposite ends of the mounting plate 18 and terminate in nipples 45 each for connection to a respective gas supply pipe, not shown.

In the described arrangement there are, for purposes of safety, two gas passages 40, 40' provided for the orifice 30. The orifice 32 is similarly equipped with two gas passages 44, 44'. It is thought safer to supply oxygen separately from acetylene or propane to the gas outlet member 42 for mixture thereat rather than to feed the gases already premixed into the valve mounting plate 18. Trials may establish that it is not unduly risky to supply premixed gases, in which case only one passage may be required to gas outlet member 42. If no combustible gas is ever to be fed to the orifices 30 and 32, then only one passage 40 or 44 leading to gas outlet member 42 will suffice.

Figure 5A:
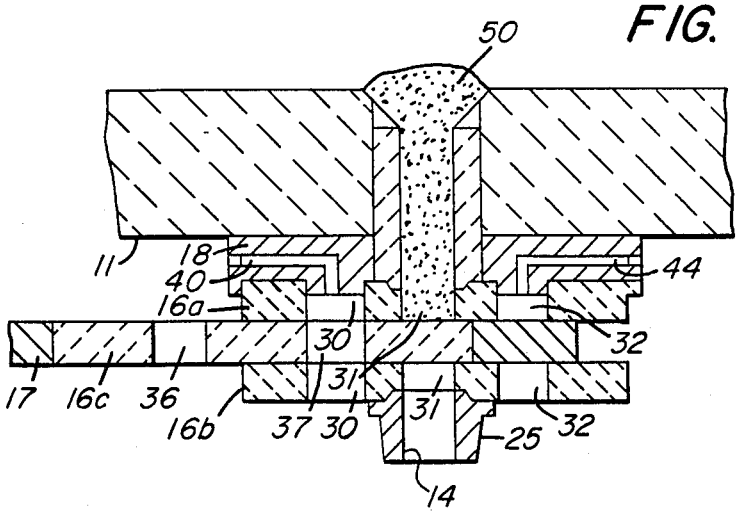
FIGS. 5A, 5B and 5C schematically illustrate a valve being operated through a sequence of operational steps.

Referring to the schematics shown in FIG. 5*a*, 5*b* and 5*c*, an exemplary sequence of operations is described as follows. The first operation, illustrated in FIG. 5*a*, involves readying the vessel for receiving a charge of melt. The vessel and valve are preheated, as is usual. Then, gate plate 16*c* is positioned in the flow-preventing position as shown. A nozzle, or well, filler 50, such as sand, may then be applied to the well opening, as is common practice. The vessel can then be filled with melt.

The first operation continues by topping up the preheating of the orifice 37 in the gate plate 16*c*. Accordingly, combustible gas (e.g. oxygen and acetylene or propane) is fed to orifice 37 via passages, 40, 40', and the orifice 30 of upper plate 16*a*. The gases are ignited and burn within the space defined by the three presently registered orifices 30, 37, 30.

Figure 5B:
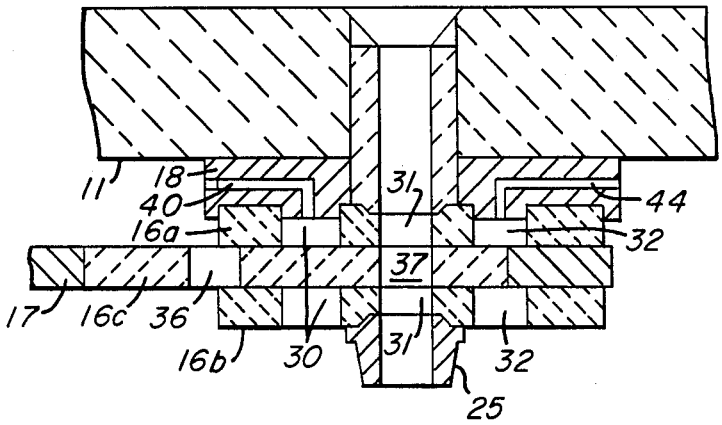

After this pre-heat, the gate plate 16*c* can be moved rightwards to register its orifice 37 with the orifices 31 for the teeming operation, as illustrated in FIG. 5B. Exact registry of the gate plate orifice 37 with the orifice 31 in the two stationary plates 16*a* and 16*b* is the full-open valve setting. Partial registry may be adopted, as is known, for metering the melt flow.

Figure 5C:
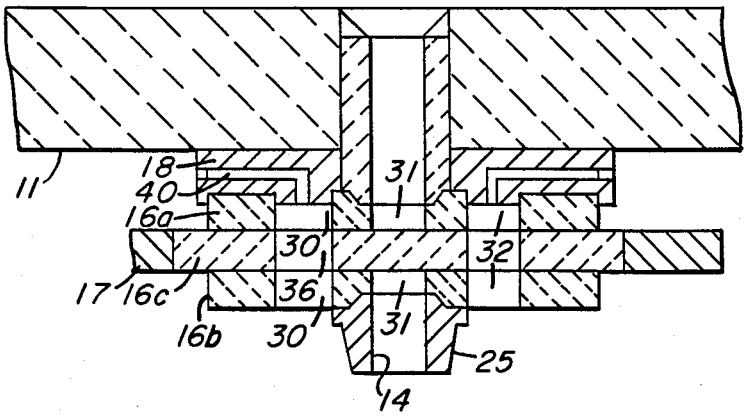

When teeming is interrupted, the operation illustrated in FIG. 5C can be initiated. The plate 16*c* is moved to the right, interposing the imperforate portion 38 between the orifices 31. Gate plate orifice 37 is now registered with stationary plate orifices 32. Also, gate plate orifice 36 is in registry with stationary plate orifices 30. Combustible gas can then be fed to orifice 36 and ignited for preheating, as disclosed above. Meanwhile, the operator has the possibility of cleaning orifice 37 to remove solidified matter. Cleaning is performed by "lancing" with air or oxygen. The lancing gas is fed via passage 44 or 44', outlet member 46 and orifice 32 of the upper stationary plate 16*a*. Teeming can now recommence, using orifice 36.

Figure 6:
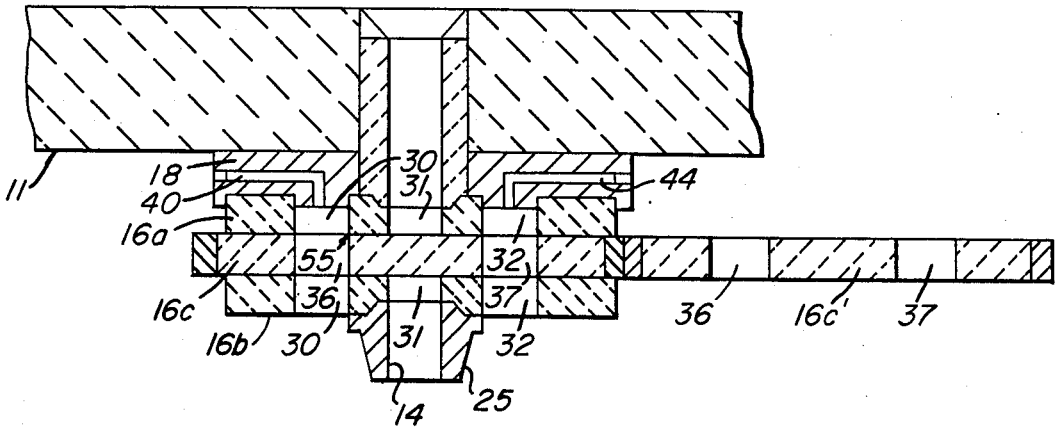
FIG. 6 is a schematic illustration of an operational step performed by a modified form of the valve.

FIG. 6 illustrates a slightly modified form of a valve arrangement in which the reciprocably movable gate 16*c* of the previous embodiment is replaced by a plurality of gates 16*c'* that are pushed sequentially between the stationary plates 16*a* and 16*b*. In this form of arrangement, depending on the design of the cassetted plates, while the orifice 36 in one gate 16*c'* is in use, the orifice 37 in the next gate plate can be preheated as described above. Alternatively, when teeming is next interrupted, orifice 37 of the next gate plate is preheated prior to bringing it into use. During this teeming stoppage, the previously used orifice 36 is lanced.

So long as each cassetted gate plate leaving the valve is sound, it can be returned to an infeed side of the valve, in due course to be brought into use.

Each cassetted gate plate 16*c'* can be inspected, in situ, in the position shown in FIG. 6. The right-hand plate 16*c'* is positioned for inspection. The plate will be rejected if inspection detects cracks or undue erosion or attack of the refractory, in particular, in the vicinity of the two refractories. Otherwise, the plate will be reused.

When a valve is closed, it sometimes happens that there is a leakage. Leakage may occur if either of the refractories 16*a*, 16*b* become worn in the vicinity of their orifices, for example at 55 in FIG. 6. If a leak develops, it can progress into a dangerous breakout. The present valve affords a safety facility of freezing the leakage. Thus, if the effect of a leakage at 55 is detected in orifice 30, cold inert gas is injected along the passage 40 (or 40', or both) to orifice 36, to freeze the leaking melt and thus block the leak. Should a leak be detected in orifice 32, cold inert gas will similarly be injected along passage 44 or 44' or both into orifice 37. The valve 10 can be equipped with suitable gas connections to switch from preheating gas or lancing gas to cooling gas.

Experience shows that the sliding plate of a sliding gate valve has about half the service life of the stationary plates. A gate plate of cassette form as illustrated herein is a singular convenience to the user but is not an indispensable feature of the invention, which can be embodied in a two-, or three-plate, reciprocally acting valve.

The gate plate **16*b*** shown in the drawings is a two-orifice plate. It could, however, be a single orifice or multi-orifice plate.

In the cassetted or push-through valve of FIG. 6, the gate plate **16*c'* moves unidirectionally. For this reason, two orifices 30, 32 are provided in plate 16*a* for use in preheating before a teem and in lancing afterwards. Should the user demand only one of these facilities, i.e. preheating or lancing or vice versa, only an appropriate one of the orifices 30, 32** is needed with the associated means to feed gas thereto.

The facility afforded by this invention to top-up preheat, to lance and to freeze leaks would be desirably featured in other gate valves for use in controlling metal teeming.

Should the invention be implemented in other types of valve, the stationary plate may need have only one orifice for feeding a suitable gas into the or a gate plate teeming orifice. Such would be the case with a valve whose gate plate is movable to and fro, e.g. a reciprocally acting two plate valve. Such a valve has a stationary upper plate and a slidable lower plate possessing one or more teeming orifices. The slidable plate can be linearly reciprocal, as is well known. In a manner akin to the presently disclosed valve, the sole stationary plate can have an orifice, or orifices, alongside its teeming orifice for supplying preheating, lancing or cooling gases into the teeming orifice(s) of the gate plate, such gases being conveyed preferably through the mounting plate 18.

What is claimed is:

1. A sliding gate valve for controlling the flow of molten metal from the pour opening of a teeming vessel comprising:

a mounting plate attached to said teeming vessel about the pour opening thereof;

a stationary plate secured to said mounting plate and having a teeming orifice in registry with said teeming vessel pour opening;

a second orifice in said stationary plate longitudinally spaced from the teeming orifice therein;

a movable gate having a teeming orifice in sliding contact with said stationary plate, said gate being selectively movable to place its teeming orifice into registry with either of the orifice in said stationary plate; and gas feed means communicating with said stationary plate second orifice including means for directing gas fed to said second orifice away from said teeming vessel and through said gate orifice when it is placed in registry with said stationary plate second orifice.

2. A valve according to claim 1 wherein said gas feed means includes a gas nozzle effective to establish a jet of gas directed substantially axially of said stationary plate second orifice for substantially axial admission into said gate teeming orifice.

3. A valve according to claim 2 wherein said gas feed means comprises a gas nozzle attached to said mounting plate and passage means through said mounting plate for connecting said nozzle to a gas supply source.

4. A valve according to any one of claims 1, 2 or 3 wherein said stationary plate contains at least two second orifices and gas feed means connected thereto effective to admit one or more gases to said gate teeming orifice when said gate teeming orifice is placed in alternate registry with either of said second orifices.

5. A valve according to claim 4 in which each of said gas feed means are connected to independent gas sources.

6. A valve according to claim 5 in which said gas feed means are arranged to supply a gas for flame-preheating and for lancing respectively, and said gate is movable to register its teeming orifice with the orifices in said stationary plate sequentially for flame-preheating, teeming and lancing.

7. A valve according to claim 1 in which said gas feed means communicates with a source of combustible gas for burning within said gate teeming orifice when it is in registry with said second orifice in said stationary plate.

8. A valve according to claim 1 in which said gas feed means communicates with a source of oxygen for lancing said gate teeming orifice when it is in registry with said second orifice in said stationary plate.

9. A valve according to claim 1 in which said gas feed means communicates with a source of inert gas effective to freeze molten metal in said gate teeming orifice when it is in registry with said second orifice in said stationary plate.

10. A method of teeming molten metal from a vessel employing a teeming valve having a stationary plate containing a teeming orifice and a second orifice longitudinally spaced from the teeming orifice, a movable gate having a teeming orifice therein, and gas supply means communicating wih said stationary plate second orifice, said method comprising the steps of:

(a) placing said gate teeming orifice in registry with said stationary plate teeming orifice for the discharge of molten metal from said vessel;

(b) moving said gate teeming orifice from registry with said stationary plate teeming orifice into registry with said stationary plate second orifice; and (c) supplying inert gas to said stationary plate second orifice when leaking of molten metal is detected through the interface between said stationary plate and said gate to freeze and thereby block the leakage.

* * * * *